United States Patent [19]

Semon

[11] 4,195,394

[45] Apr. 1, 1980

[54] CASKET CORNER PIECE

[76] Inventor: William J. Semon, 505 Fuller Rd., Dalton, Pa. 18414

[21] Appl. No.: 913,602

[22] Filed: Jun. 8, 1978

[51] Int. Cl.[2] ..... A61G 17/00

[52] U.S. Cl. ..... 27/10

[58] Field of Search ..... 27/2, 10, 5, 6

[56] References Cited

U.S. PATENT DOCUMENTS

| | | | |
|---|---|---|---|
| 1,063,393 | 6/1913 | Ryan | 27/10 |
| 1,989,962 | 2/1935 | Zinser et al. | 27/10 X |
| 2,056,419 | 10/1936 | Cohen | 27/6 X |
| 2,594,580 | 4/1952 | Paul | 27/10 |
| 3,531,837 | 10/1970 | Cherry | 27/10 |

*Primary Examiner*—John D. Yasko

*Attorney, Agent, or Firm*—Kane, Dalsimer, Kane, Sullivan and Kurucz

[57] ABSTRACT

A corner piece is adapted to be installed over a corner of a metal casket having a predetermined number of tack welds securing adjacent side and end panels to one another. The corner piece extends from the top to the bottom of the casket and includes outwardly projecting top rail and bottom rail parts together with an intermediate recessed part which mate with the casket top rail, bottom rail and intermediate section, respectively, at each corner. A downwardly projecting lip at the top of the corner piece engages with internal surfaces of the top rail and upwardly projecting surfaces at the bottom are received by recess surfaces of the bottom rail in securing the corner piece to the casket. Each corner piece is sufficiently resilient to permit the ends to be flexed and spread apart thereby facilitating mounting of the corner piece. Supplemental securing means in the nature of an adhesive as well as sealing compound are adapted to be interposed between interior surfaces of the corner piece and exterior surfaces of the casket corner. Recesses are also provided in the corner piece to receive any projecting or protruding parts of the tack welds which secure the side and end panels to one another.

8 Claims, 6 Drawing Figures

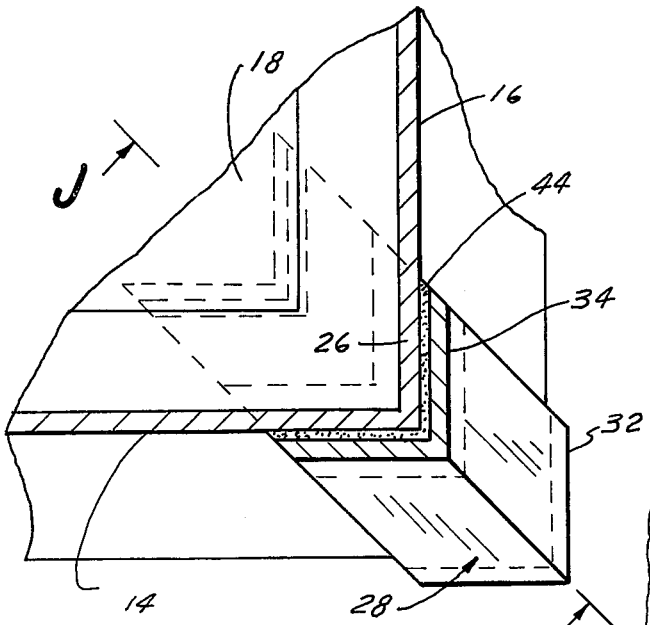
FIG. 4
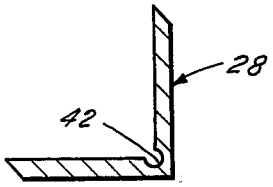
FIG. 4a
FIG. 5
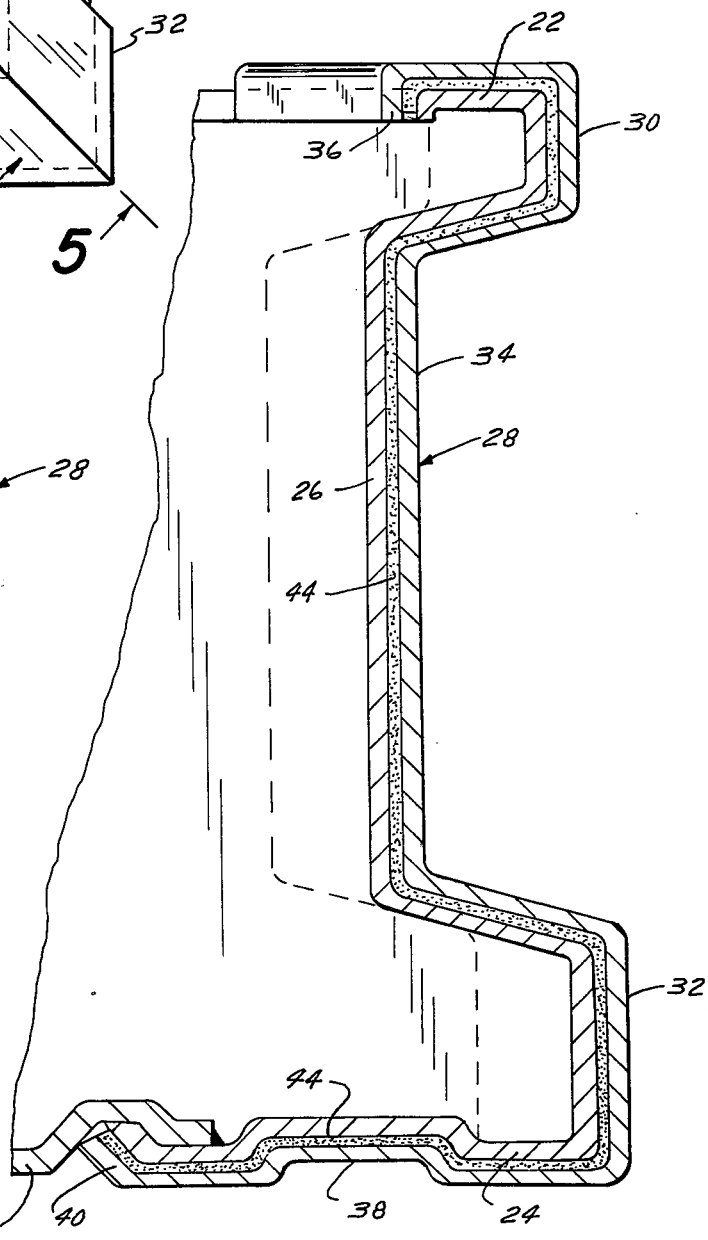

CASKET CORNER PIECE

BACKGROUND OF THE INVENTION

In the manufacture of metal caskets, and, particularly, caskets made of various grades of sheet steel or paneling, a relatively large number of manipulative steps are required, many of which necessitate the intervention of considerable manual labor. Consequently, the manufacturing cost of metal caskets is relatively high. Accordingly, it would be of extreme benefit to the industry to reduce the cost of casket manufacture by minimizing the various steps in the manufacturing process, and, of course, the intervention of manual labor.

Normally, when manufacturing metal caskets of steel, sheets and paneling of suitable dimensions will be subject to stamping operations in arriving at desired component configuration, the stamped casket parts including a cap or lid, the side and end panels as well as the bottom. The side and end panels will be initially tack welded to one another and squared. After squaring, the bottom, sides and ends will be welded to one another. In this regard approximately seven to twelve spot or tack welds will be applied at the vertical corners. If the casket is what is termed in the trade a "non-sealer", only the top and bottom rails of the sides and end panels will be completely welded to one another to provide a hermetic joint or juncture at this location. Later on in the assembly process, decorative hardware will then be applied to the corners over the sections that are merely tack welded to one another. In the event a corner piece is not added, certain manufacturers apply a "Hammond-type" metal strip to the corners between the top and bottom rails. In the event, a "sealer" casket is being manufactured, the entire corner including the top and bottom rails and the section therebetween will be completely welded.

The welded corners will be subjected to a grinding operation followed by buffing and fine finishing to obtain the desired aesthetic appearance. The cap or lid is then assembled; and, following assembly, the entire casket is then passed through a cleansing operation followed by an application of primer and paint to obtain the appropriate decorative appearance. Selected hardware for both the exterior and interior is applied and the interior is suitably trimmed with liners, cloth and other materials.

SUMMARY OF THE INVENTION

It is a principal object of the present invention to eliminate the welding and finishing operations at each corner defined by the sides and ends following the initial tacking and squaring operation. In this manner there is a considerable saving of time required for welding and finishing during the manufacturing process, as well as a saving of labor for these welding and finishing steps.

Another object is to provide at each corner, defined by the sides and ends of the casket, a corner seal adapted to overly and accommodate the tack welds and also provide a hermetic seal at each corner to render this location water and moisture proof.

Still another object is to provide a corner seal which possesses aesthetic properties, to each corner; and it may be so constructed to simply snap into and engage with recessed surfaces of the top and bottom rails because of the inherent resiliency of the corner seal.

A still further object is to provide a corner piece of the foregoing type which may be applied to each corner at essentially any stage of the manufacturing process.

Other objects and advantages will become apparent from the following detailed description which is to be taken in conjunction with the accompanying drawings.

BRIEF DESCRIPTION OF THE DRAWINGS

FIG. 4 is a cross-sectional view taken along the line 4–4 of FIG. 3;

FIG. 4*a* is an enlarged fragmentary sectional view of a corner piece with recesses to receive projecting or protruding parts of the tack welds; and FIG. 5 is a longitudinal sectional view taken along the line 5—5 of FIG. 3.

DETAILED DESCRIPTION

Figure 1:
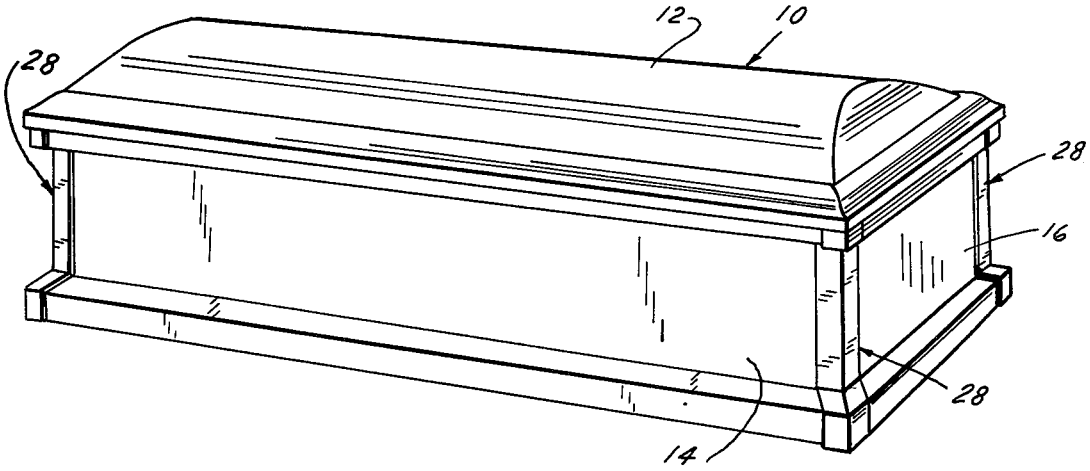
FIG. 1 is a perspective view of a metal casket incorporating the teachings of the present invention, but not including any decorative or traditional hardware.
Figure 2:
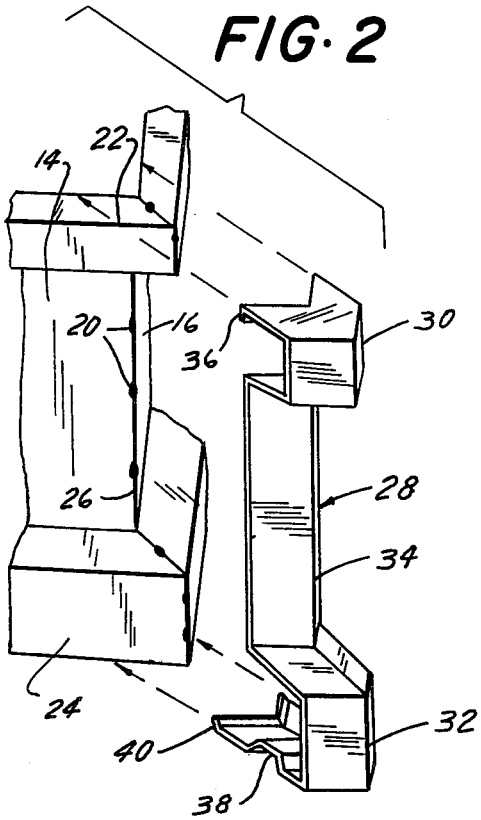
FIG. 2 is an enlarged fragmentary view of a corner of the casket showing a side and end panel tack welded together, with the corner piece, seal or trim incorporating the teachings of the present invention spaced therefrom and prior to installation on the casket over the corner and particularly the spot welds.
Figure 3:
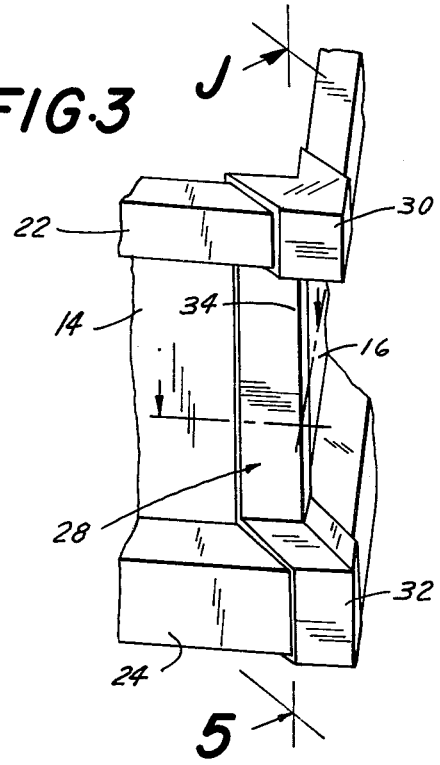
FIG. 3 is a similar fragmentary view showing the corner trim secured in place over the casket corner.

In the drawings, a casket 10 of selected metal, such as bronze, copper or the various grades of steel or zinc coated steel, is shown without conventional, decorative, functional or traditional hardware. The casket 10 may be of any one of many different styles and variety including the full and half couch designs. Towards this end, a typical casket will include a cap or lid 12, opposed side panels 14 and end panels 16, as well as a base or bottom 18 (FIG. 5).

In the normal course of securing and squaring the side panels 14 with the end panels 16, a number of tack or spot welds 20 are applied at the top rail 22, bottom rail 24 as well as the intermediate section 26 of the juncture therebetween.

At essentially any stage of the ensuing manufacturing and assembly procedures, the present invention contemplates the application and installation of a corner seal, trim or piece 28 at each of the corners between the side panel 14 and end panel 16.

Each of the corner pieces 28 is fabricated to closely follow the contour of the casket corners including that of the top rail 22, bottom rail 24 and intermediate section 26 across the width thereof. In this connection, each corner piece 28 will include a top rail part 30, a bottom rail part 32 and an intermediate part 34, each corresponding in shape with the receiving casket corner, and, particularly the respective top rail 22, bottom rail 24 and intermediate section 26. In addition, the top rail part 30 will include a downwardly depending lip 36 designed to engage with adjacent surfaces of the interior of the top rail 22 in order to latch these surfaces to one another during installation of the corner piece. In addition, the bottom rail part 32 of the corner piece 28 will include an upwardly projecting lug 38 and terminal lip 40, advantageously received in accommodating recesses in the bottom rail 24 and bottom 18 to securely lock these mating surfaces of the corner piece 28 and bottom rail 24 to one another. In order to facilitate the installation or assembly of each corner piece 28, at the selected casket corner, the present invention contemplates providing each piece with sufficient resiliency to permit the top rail part 30 and bottom rail part 32 to flex outwardly and away from one another in order to permit the lips 36 and 40 to clear and ride over the top rail 22 and bottom rail 24, respectively. Thus, the corner pieces 28 will be structural in nature and also provide decorative effects where desired or needed. Towards this end, each corner piece 28 may be fabricated of suitable metal, resin or fibrous material possessing the necessary structural properties. If necessary, the corner of each corner piece 28 may have suitable recesses 42 to accommodate and receive any outwardly projecting protions of the tack welds 20. Of course, the corner piece 28 may be of substantially any thickness and width depending upon the strength desired and selected aesthetic effect.

In certain instances, the present invention contemplates further securement of each corner piece 28 to the casket, as for example, by a suitable adhesive or mechanically by screw, rivet or welding at strategic locations which will not seriously or detrimentally affect the desired aesthetic value of each corner piece 28.

In addition, the present invention proposes to take advantage of each corner piece 28 by having this piece contribute to the waterproof or tightness of each corner of the casket through the interposition of a sealing compound, which in certain instances may also have adhesive properties. A layer 44 of a compound of this type is clearly shown in FIG. 4 and 5.

Thus, it will be evident that the grinding, buffing and fine finishing procedures heretofore employed in the industry at each of the casket corners is most effectively eliminated by the provision of the corner pieces or trim 28, each of which may be contourned and finished to provide the desired aesthetic appearance. Of course, corner hardware may still be applied at each of the casket corners over the corner pieces 28 to arrive at the various casket styles of each manufacturer and supplier. It is also envisioned that each corner piece 28 will be automatically applied to each corner as well as manually installed.

As explained in the above, each corner piece 28 may be applied at practically any stage of the casket manufacturing operation, whether it be at the preliminary stages of casket manufacture or at some later stage. In this connection, the corner pieces 28 may be prefinished or of a nature to receive paint during the spray finishing operation.

With the elimination of the grinding, buffing and fine finishing operations at each corner, there is a corresponding increase in production, decrease in required manual labor, decrease in noise abatement and dust from such procedures. With noise abatement and dust reduction, there is a pronounced reduction in health hazards that may otherwise ensue.

Thus the several aforenoted objects and advantages are most effectively attained. Although a single somewhat preferred embodiment of the invention has been disclosed and described in detail herein it should be understood that this invention is in no sense limited thereby and its scope is to be determined by that of the appended claims.

What is claimed is:

1. An improved metal casket comprising in combination:

a pair of spaced side panels each having opposed ends;

a pair of spaced end panels each having opposed ends, the panels being so constructed and arranged that an end of a side panel is proximate an end of an end panel and such proximate ends being connected by a predetermined number of tack welds to define four corners extending from the top to the bottom of the casket;

a bottom secured to each of the panels, and a cap extending over the top of the casket; and a corner piece over at least one of the corners extending from the top to the bottom of the casket, and the corner piece being secured in place on the casket, the panels being so constructed and arranged to define an outwardly projecting top rail and bottom rail over which a part of the corner piece is disposed, with the corner piece having a configuration and shape corresponding to that of its mating corner from the casket top to the casket bottom including the top and bottom rails, each corner piece including a downwardly projecting means at its top for engaging with internal surfaces of the top rail and upwardly projecting means for engaging with accommodating recess surfaces of the bottom rail for cooperating in securing the corner piece to the casket, and each corner piece being sufficiently resilient to permit spreading of the top and bottom thereof to facilitate mounting of the corner piece on its corner.

2. The invention in accordance with claim 1, wherein a corner piece is at each of the four corners of the casket.

3. The invention in accordance with claim 1, wherein supplemental securing means cooperates in securing each corner piece on the casket.

4. The invention in accordance with claim 3, wherein the supplemental securing means includes a layer of adhesive interposed between interior surfaces of the corner piece and exterior surfaces of its corner.

5. The invention in accordance with claim 3, wherein the supplemental securing means is in the nature of a sealing compound which seals the junction between the corner piece and neighboring surfaces of the corner and tack welded ends.

6. The invention in accordance with claim 1, wherein each corner piece is suitably recessed to receive and accommodate outwardly projecting portions of the tack welds.

7. A corner piece for installation over a corner of a metal casket having a predetermined number of tack welds securing adjacent side and end panels to one another, the corner piece adapted to extend from the top to the bottom of the casket and be secured in place thereon over the corner with each panel being so constructed and arranged to define an outwardly projecting top and bottom rail and a recessed intermediate section therebetween, the corner piece having an outwardly projecting top rail part and bottom rail part and an intermediate recessed part therebetween for extending over and mating with the casket top rail, bottom rail and intermediate section, respectively, each corner piece including a downwardly projecting means at its top for engaging with internal surfaces of the top rail and upwardly projecting means for engaging with accommodating recess surfaces of the bottom rail for cooperating in securing the corner piece to the casket and each corner piece being sufficiently resilient to permit spreading of the top and bottom thereof to facilitate mounting of the corner piece on its corner.

8. The invention in accordance with claim 7, wherein each corner piece is suitably recessed to receive and accommodate outwardly projecting portions of the tack welds.

* * * * *